US005118547A

United States Patent [19]

Chen

[11] Patent Number: 5,118,547

[45] Date of Patent: Jun. 2, 1992

[54] STRUCTURE OF FIBER GLASS FLOOR TILE

[75] Inventor: Victor Chen, Taipei, Taiwan

[73] Assignee: Chien-Pao Enterprise Co., Ltd., Taiwan

[21] Appl. No.: 540,056

[22] Filed: Jun. 19, 1990

[51] Int. Cl.[5] ..... E01C 5/22

[52] U.S. Cl. ..... 428/44; 428/58; 428/81; 428/156; 428/167; 52/588; 52/593; 404/41

[58] Field of Search ..... 428/44, 58, 99, 192, 428/156, 167, 81; 404/41, 32, 33, 34; 52/588, 593

*Primary Examiner*—Alexander S. Thomas

*Attorney, Agent, or Firm*—Lowe, Price, LeBlanc & Becker

[57] ABSTRACT

Disclosed is a structure of square floor tile, which is made of glass fiber mixed with heat setting resin, calcium carbonate and hardener through casting process, and comprises two pair of parallel ribs on the bottom and vertically intersected with each other. The parallel ribs have each two notches thereon, a dovetail mortise at one end and a dovetail tenon at an opposite end. By means of the engagement of the dovetail mortises of one floor tile with the dovetail tenons of another floor tile, floor tiles are automatically aligned with one another after they are connected together longitudinally and transversely.

3 Claims, 3 Drawing Sheets

FIG. 2A
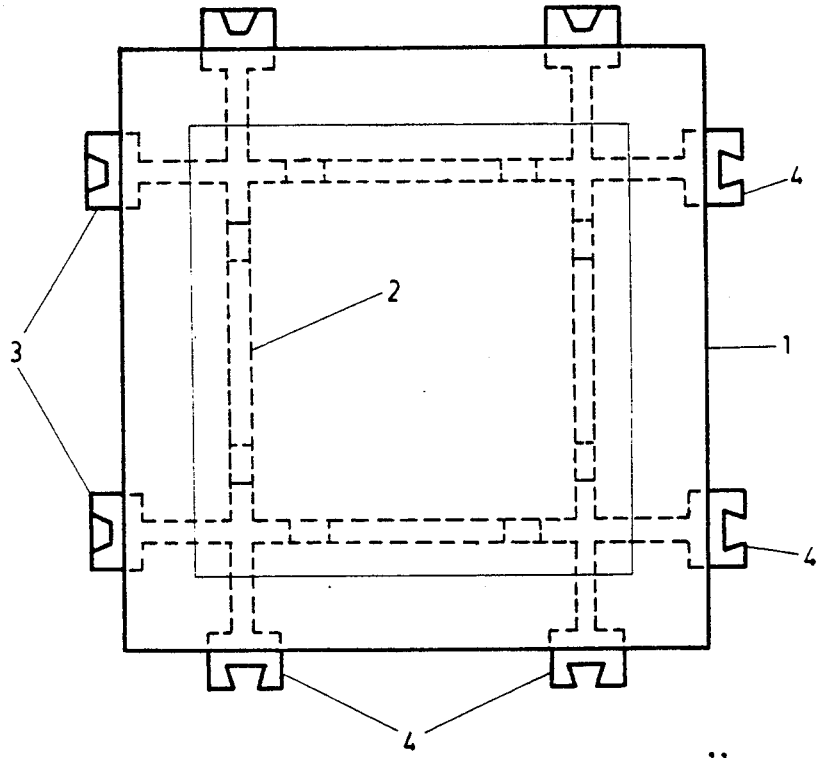
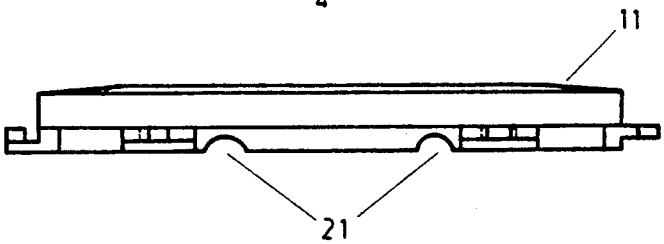
FIG. 2B

STRUCTURE OF FIBER GLASS FLOOR TILE

BACKGROUND OF THE INVENTION

The present invention is related to floor tiles and more particularly to a floor tile which can be automatically aligned during flooring process to cover the surface of a floor.

During construction work, ceramic or plastic tiles and bricks are commonly used for flooring. Ceramic tiles or bricks are more rigid in structure but easy to break during transportation and more expensive to manufacture. During flooring operation, air may be retained within the gap between concrete and floor tiles to affect the sticking of floor tiles to concrete. Plastic tiles or bricks are relatively inexpensive to manufacture but not durable in use and easy to deform due to temperature change or water wash. Further, during covering the surface of a floor with conventional floor tiles or bricks of any type, each tile or brick must be carefully aligned with the hands. Floor tile or brick alignment process will waste much time in flooring operation.

SUMMARY OF THE INVENTION

The present invention is to provide a structure of floor tile which is made of fiber glass mixed with heat setting resin, calcium carbonate and hardener through casting process, and comprises two pair of parallel ribs on the bottom and vertically intersected with each other. The parallel ribs have each two notches thereon, a dovetail mortise at one end and a dovetail tenon at an opposite end. During flooring operation, air is exhausted through the notches and floor tiles are automatically aligned after the dovetail mortises and dovetail tenons of one floor tile are respectively connected with the dovetail tenons and dovetail mortise of another floor tile.

BRIEF DESCRIPTION OF THE DRAWINGS

The present invention will now be described by way of example with reference to the annexed drawings, in which:

FIG. 2A is a schematic plan view of the floor tile of this invention;

FIG. 2B is a side view of the tile of FIG. 2A;

DETAILED DESCRIPTION OF THE PREFERRED EMBODIMENTS

Figure 1:
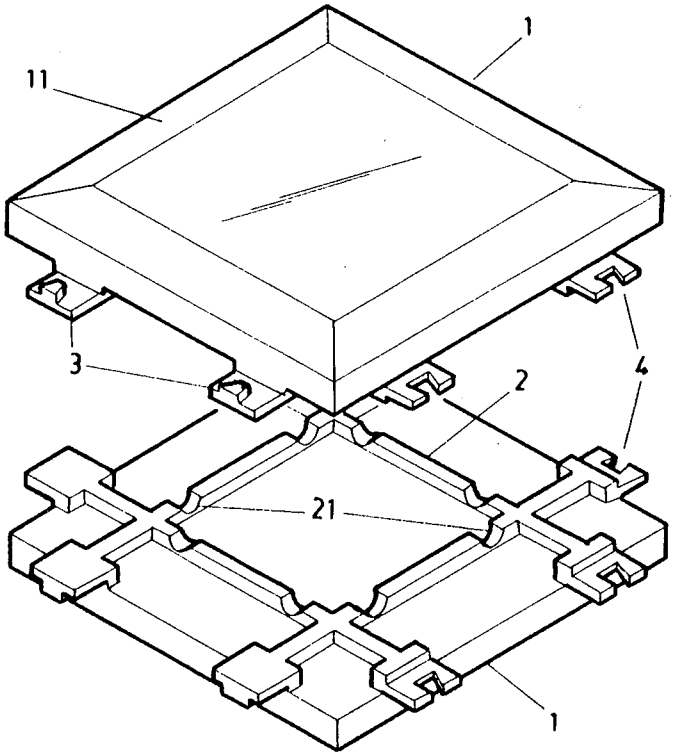
FIG. 1 is a perspective top view and a perspective bottom view of a fiber glass floor tile embodying the present invention.

Referring to FIG. 1, there is illustrated a square floor tile 1 embodying the present invention, which is made of glass fiber mixed with heat setting resin, calcium carbonate and hardener through casting process, and which comprises four tapered planes 11 on the top around the periphery, an unitary rib 2 on the bottom and having a plurality of notches 21 symmetrically arranged at suitable locations for ventilation. The rib 2 comprises eight terminal ends in expanded size and projecting over the periphery of the tile 1, which terminal ends have each a dovetail tenon 3 or dovetail mortise 4 made thereon such that a dovetail mortise 4 is disposed at one end while a dovetail tenon 3 is disposed at an opposite end.

Figure 3:
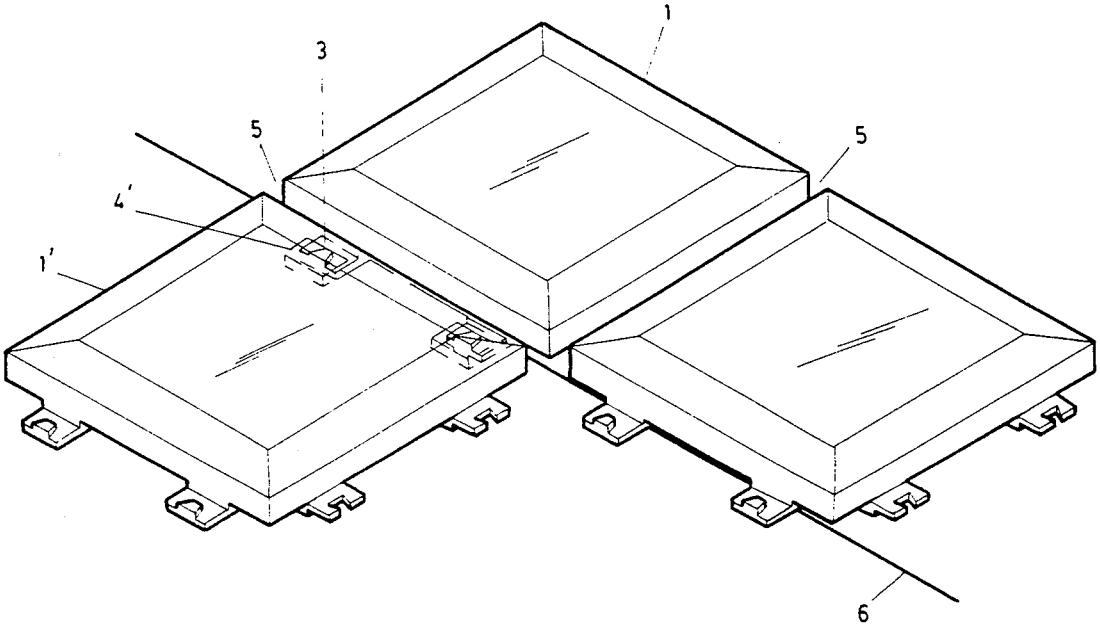
FIG. 3 is a schematic drawing illustrating the construction procedure to cover the surface of a floor with the present invention.

Referring to FIG. 3, the process to cover over the surface of a floor with fiber glass floor tiles of the present invention is outlined hereinafter. Draw a reference line 6 on the floor and connect fiber glass floor tile 1 in series along such a reference line 6. Attach other fiber glass floor tiles 1' to the first fiber glass floor tile 1 longitudinally and transversely permitting the dovetail tenons 3 of one tile to fastened in the dovetail mortises 4 of another. After fiber glass floor tiles 1, 1' are all attached together to cover the surface of the floor, a pitch of 5 mm is left between each two fiber glass floor tiles and all the fiber glass floor tiles are automatically aligned without any rectification.

As described above, the present invention is to provide such a floor tilt which can achieve the following advantages.

I. Suitable for mass production: The present invention is made of glass fiber mixed with heat setting resin, calcium carbonate and hardener through casting process so that mass production can be attained.

II. Easy to install: By means of the engagement of the dovetail tenons of one floor tile with the dovetail mortise of another floor tiles can be conveniently connected together longitudinally and transversely to cover the surface of a floor without causing any significant alignment error.

III. High sticking capability to the concrete: By means of the design of the notches on the rib, air within the rib is completely exhausted when the tile is stuck to the concrete on a floor during pavement so that the pt-shaped rib is tightly fastened in the concrete to secure the floor tile thereto.

IV. Rigid in structure: The floor tile is integrally shape molded through casting and is rigid in structure and provides good shock and wear resisting properties.

V. Heat resisting and easy to clean: According to a flame resistance test on a floor tile (FRP Plate) of the present invention made by Union Chemical Laboratories, Industrial Technology Research Institute, a floor tile of the present invention fits UL-94VO specifications. With water or any detergent, a floor tile of the present invention can be easily cleaned.

VI. Good alignment and beautiful appearance: Since low alignment error can be achieved during pavement of the present invention on the surface of a floor, flat covering of floor tiles in good alignment provide a sense of beauty.

I claim:

1. A square floor tile having top and bottom surfaces, made by casting glass fiber mixed with heat setting resin, calcium carbonate and hardener comprising two pair of parallel ribs formed on the bottom surface and vertically intersected with each other, said parallel ribs each having two notches therein and two opposite ends expanded in size, said two opposite ends of each rib projecting beyond the periphery of said tile and forming respectively a dovetail tenon and a dovetail mortise dimensioned to be received therein.

2. The square floor tile of claim 1, wherein a plurality thereof are provided and wherein said dovetail tenons and said dovetail mortises are respectively dimensioned to be connected with the dovetail mortises and dovetail tenons of other of said square floor tiles whereby a plurality thereof cover the surface of a floor so that the connected floor tiles are automatically aligned.

3. The square floor tile of claim 1, wherein the the notches in said ribs are dimensioned to exhaust the air confined within said ribs when the floor tile is stuck on a concrete base floor.

* * * * *